US006023900A

United States Patent [19]

Stoehr et al.

[11] Patent Number: 6,023,900

[45] **Date of Patent: *Feb. 15, 2000**

[54] FINGER JOINTED FLOORBOARD WITH SANDABLE WEAR SURFACE

[75] Inventors: James H. Stoehr; Michael W. Niese, both of Cincinnati, Ohio; John Williams, Antigo, Wis.

[73] Assignee: Robbins, Inc., Cincinnati, Ohio

[ * ] Notice: This patent is subject to a terminal disclaimer.

[21] Appl. No.: 09/304,478

[22] Filed: May 3, 1999

Related U.S. Application Data

[63] Continuation of application No. 08/888,446, Jul. 7, 1997, Pat. No. 5,938,967.

[51] Int. Cl.[7] ..... E04B 1/62

[52] U.S. Cl. ..... 52/403.1; 52/177; 52/480; 403/364

[58] Field of Search ..... 52/177, 589.1, 52/591.2, 592.1, 403.1; 403/364

[56] References Cited

U.S. PATENT DOCUMENTS

| | | |
|---|---|---|
| 2,300,728 | 11/1942 | Goss . |
| 2,334,113 | 11/1943 | Maiarkey . |
| 2,457,498 | 12/1948 | Russell et al. . |
| 2,908,600 | 10/1959 | Nicholson . |
| 3,021,248 | 2/1962 | Mann et al. . |
| 3,046,181 | 7/1962 | Mann et al. . |
| 3,084,090 | 4/1963 | Rambo et al. . |
| 3,262,723 | 7/1966 | Strickler . |
| 3,388,020 | 6/1968 | Gates . |
| 3,730,797 | 5/1973 | Jensen . |
| 3,802,986 | 4/1974 | Forsythe . |
| 3,927,705 | 12/1975 | Cromeens et al. . |
| 3,963,555 | 6/1976 | Zweig . |
| 3,971,693 | 7/1976 | Pedersen . |
| 3,985,169 | 10/1976 | Chow . |
| 4,041,998 | 8/1977 | Moorley . |
| 4,128,119 | 12/1978 | Maier . |
| 4,130,150 | 12/1978 | Cook et al. . |
| 4,243,465 | 1/1981 | Gozzi . |
| 4,248,280 | 2/1981 | Taylor . |
| 4,314,871 | 2/1982 | Weinstock et al. . |
| 4,430,371 | 2/1984 | Boyes . |
| 5,113,632 | 5/1992 | Hanson . |
| 5,149,108 | 9/1992 | Leiszter . |
| 5,277,010 | 1/1994 | Stephenson . |
| 5,369,927 | 12/1994 | Counihan . |
| 5,412,917 | 5/1995 | Shelton . |
| 5,433,052 | 7/1995 | Niese . |
| 5,540,024 | 7/1996 | Stalford . |

FOREIGN PATENT DOCUMENTS

| | | | |
|---|---|---|---|
| 843330 | 6/1939 | France | 403/364 |
| 1032398 | 7/1953 | France | 403/364 |
| 73755 | 9/1960 | France | 403/364 |

OTHER PUBLICATIONS

Joinery Brochure.

*Primary Examiner*—Beth A. Aubrey
*Attorney, Agent, or Firm*—Wood, Herron & Evans L.L.P.

[57] ABSTRACT

A finger jointed floorboard or laminatable floorboard section of two connected shorter pieces includes a relatively thick upper wear region which may be sanded without exposing the fingers forming the connection, regardless of whether or not the pieces are connected in the same longitudinal and transverse horizontal planes. The structure and orientation of this finger joint allows flooring manufacturers to maximize the yield of typically solid, good quality floorboard material and to reduce installation costs, without adversely affecting the aesthetic quality of the installed floor. In one embodiment, a finger jointed board with a central finger joint is sawed in a horizontal plane through the joint to produce two identical, laminatable floorboard sections. With a thicker starting board having two separate, spaced finger joint connections, sawing along a horizontal midplane produces two identical intermediate boards, each with a centrally located finger joint. Each intermediate board is then sawed through the finger joint connection to produce a total of four laminatable floorboard sections.

6 Claims, 2 Drawing Sheets

FINGER JOINTED FLOORBOARD WITH SANDABLE WEAR SURFACE

This application is a continuation application of co-pending U.S. application Ser. No. 08/888,446, filed Jul. 7, 1997 now U.S. Pat. No. 5,938,967, the disclosure of which is incorporated herein by reference in its entirety.

FIELD OF THE INVENTION

This invention relates to wood floor systems, and more particularly, to the upper layer of floorboards which typically form the wear surface of such a floor system.

BACKGROUND OF THE INVENTION

For wood floors suitable for either residential or sports use, elongated, tongue and groove floorboards are generally used to provide an upper layer which has uniform structural characteristics and is aesthetically pleasing. Typically, the floorboards are strips of solid wood having a predetermined thickness. The strips are laid end to end in parallel rows, with the floorboards of each row interconnected via the tongue and the groove to the floorboards of adjacent rows. For structural stability, the ends of the floorboards of each row are staggered with respect to the ends of the floorboards of the adjacent rows. This structure forms an upper layer having a predetermined thickness, or vertical dimension, which is equal to the thickness of the individual floorboards. Floorboards may be of oak, maple, cherry or any other type of hardwood, or even of soft wood in some instances.

The overall cost of a wood floor system depends to a large extent on the cost of the wood components, and particularly the upper layer of floorboards. For the floorboards, cost generally increases with length. This characterization is general because it has proved neither practical nor cost effective for floor manufacturers to supply all solid floorboards of identical length, primarily because manufacturing operations require a finite number of sawing steps to be performed on boards of varying length. Requiring precise uniformity in length for all floorboards would increase overall costs, due to the inability to use the shorter end pieces. This would also increase the waste.

In recognition of these factors, and to assist manufacturers of floorboards in the pricing of floorboards, the Maple Flooring Manufacturer's Association (MFMA) has established criteria for grading the upper layer of a floor system in a manner which does not require exact uniformity in length for all boards. This criteria includes reference to length. For instance, top quality, or first grade, means that at least 50% of the floorboards are between 4' and 8' in length, though most are about 4.5', and only 10% are 15" or less. Second grade means that 20% of the floorboards may be 18" or less. Third grade means that up to 55% of the floorboards may be 18" or shorter.

While a floor system having an upper layer of shorter floorboards can function structurally as well as a floor system with an upper layer of longer floorboards, the shorter length of the floorboards does present some disadvantages, particularly with respect to installation. Staggering the ends of the floorboards of adjacently located rows takes longer because there are more pieces. Staggering can also present a problem if the upper layer is supported on spaced sleepers, since no single sleeper should be located below floorboard end joints of adjacently located rows.

Thus, in the wood floor system industry there has been a need to provide floorboards of uniform length and quality to facilitate the purchase and installation of reasonably priced floor systems. To this end, it is known in the industry to interconnect shorter pieces to form longer floorboards. One process used to form this interconnection is referred to as finger jointing, because fingers are sawed into the ends of the shorter pieces and the fingers are then interleaved to form a connected joint. Process and apparatus for finger jointing floorboards are disclosed in Goss U.S. Pat. No. 2,300,728; Malarky U.S. Pat. No. 2,334,113; Nicholson U.S. Pat. No. 2,908,600; Mann et al. U.S. Pat. No. 3,046,181; Gates U.S. Pat. No. 3,388,020; Cromeens et al. U.S. Pat. No. 3,927,705; and Maier U.S. Pat. No. 4,128,119.

While it is known in the industry to join relatively short floorboard pieces in end to end relationship via a finger jointed connection to form a longer floorboard, typical methods and apparatus for finger jointing floorboards often produce an upper layer which is not aesthetically pleasing, particularly if the floor surface must be sanded after installation. For a floorboard having an interleaved finger joint which extends the entire vertical dimension of the board, sanding the top or wear surface of the board may expose extended portions of the top fingers. If the two shorter boards are not joined precisely in the same longitudinal and transverse planes, as invariably occurs with typical, high tolerance finger jointing machines, sanding of the installed floorboards will expose uneven portions of the fingers, thereby exposing the horizontal unevenness of the finger jointed connection and resulting in an unsightly upper surface.

It is an object of this invention to improve upon the aesthetic appearance of a finger jointed floorboard which must be sanded after installation, without significantly increasing the cost of manufacture thereof.

It is another objective of the invention to reduce the amount of waste generated during the manufacture of floorboards used to form an upper layer of a floor system.

It is still another objective of this invention to maximize the utilization of relatively expensive floorboard resources in the manufacture and installation of a wood floor system having an aesthetically pleasing upper surface.

SUMMARY OF THE INVENTION

The above-stated objectives are achieved by utilizing a floorboard formed of two shorter pieces via an interleaved finger joint, wherein the finger joint itself resides sufficiently below the top surface of the floorboard to provide a relatively thick region, with no fingers, below the top surface of the floorboard. This thick region, or wear surface, enables the finger jointed floorboard to be sanded without exposing any of the fingers which form the connection.

Because this relatively thick wear surface eliminates a primary disadvantage of finger jointed floorboards, this invention assures a high quality wood floor with finger jointed floorboards. With this added assurance, multiple short pieces may be interconnected to form floorboards of uniform length, and the benefits of uniformity in length, i.e., easier installation, will also be available. In short, the location and orientation of this finger jointed interconnection provides all of the previous known benefits of interconnecting short pieces of floor boards, i.e., reduced waste, simplified installation, lower floor costs, while at the same time assuring a uniform and aesthetically appealing floor surface.

According to a preferred embodiment of the invention, a finger jointed floorboard of predetermined thickness is formed from two smaller pieces via interleaved finger connections. For a floorboard having a predetermined thickness of about 1', a finger joint connection should have a height ranging in dimension of about ¾'–½', and an overall width ranging in dimension of about ¼'–½'. The vertical midpoint of the finger joint should be located below the vertical midpoint of the floorboard. This produces a wear surface of up to ½" adjacent the top of the floorboards. This wear surface enables the floor to be installed and then sanded without exposing portions of the fingers which form the connection, regardless of whether or not the shorter pieces are joined precisely in the same longitudinal and transverse horizontal planes.

Additionally, according to one method of practicing the invention, a relatively thick finger jointed board with a centrally located finger joint connection can be filleted along the horizonal midplane to produce two identical floorboard sections which may then be laminated onto less expensive pieces to provide two composite floorboards for a floor system. The location of the original finger joint connection is such that the filleting step produces a relatively thick wear surface for each of the floorboard sections, thereby allowing the resulting floor to be sanded without exposing any of the fingers of the connection. Additionally, because both the top and bottom sections of the initial finger jointed board may be used, the ultimate yield is doubled.

According to yet another method of practicing the invention, and particularly for finger joint connected short pieces having an even greater thickness, i.e., about ½"–2", two spaced sets of finger joint connections may be used. Then, in a first resawing step, the jointed board is filleted in a horizontal plane half way between the two separate finger joint connections. This forms two intermediate boards, each having a centrally located finger joint. Subsequently, each of two separate intermediate boards is again filleted in a horizontal midplane, i.e., through the center of the finger joint connection. This results in four identical floorboard sections, each having a finger joint and an upper wear surface, and being laminatable onto another piece to form a composite floorboard. This maximizes the total yield of the original floorboard material.

With all of these embodiments, whether laminated or not, the resulting finger jointed floorboard is preferably formed with a tongue and groove to assure lateral stability for the upper layer of the floor system.

These and other features of the invention will be more readily understood in view of the following detailed description and the drawings.

DETAILED DESCRIPTION OF THE DRAWINGS

Figure 1:
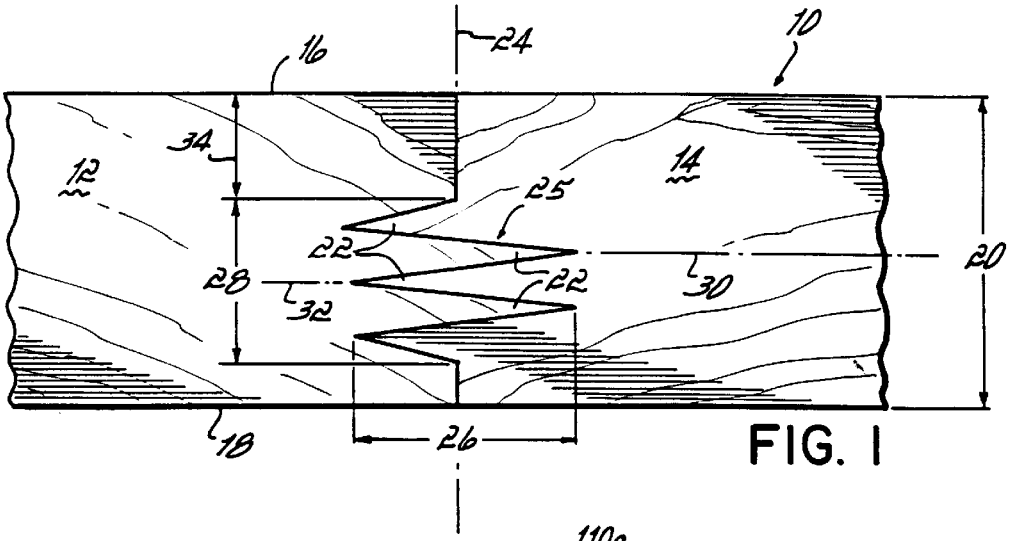
FIG. 1 is a cross sectional schematic of a floorboard with a finger joint connection in accordance with a preferred embodiment of the invention.

FIG. 1 shows a floorboard 10, preferably a tongue and groove floorboard 10, formed by end to end connection of two shorter floorboard pieces 12 and 14. The floorboard 10 has a top surface 16, a bottom surface 18 and a predetermined vertical thickness 20. Pieces 12 and 14 are interconnected via interleaved fingers 22 which are sawed into the ends of these respective pieces prior to joint. The forming of these fingers 22 is done by sawing the pieces 12 and 14, as is well known in the industry. In addition to interleaving the staggered fingers 22 of the separate pieces 12 and 14, adhesive may be used to more firmly secure pieces 12 and 14 along the vertical plane 24 of joining. Additionally, or alternatively, ultrasonic bonding may also be used.

The finger jointed interconnection 25 shown in FIG. 1 has an overall horizontal width which is designated by reference numeral 26, and an overall vertical dimension which is represented by reference numeral 28. Reference numerals 30 and 32 represent the half way marks, or the vertical midportions of the vertical dimensions 20 and 28, respectively. As shown in FIG. 1, the finger joint connection 25 formed by fingers 22 resides primarily below the half way mark 30 of the floorboard 10. This produces a relatively thick wear surface 34 between the top surface 16 and the uppermost finger 22, thereby enabling the floorboard 10 to be sanded without exposing any of the fingers 22, even if the sections 12 and 14 are not interconnected precisely in the same longitudinal and transverse horizontal planes.

The invention also contemplates variation in the dimensions of the finger joint interconnection 25 between shorter pieces 12 and 14 connected end to end to form the floorboard 10, so long as a relatively thick wear surface 34 is provided adjacent the top surface 16. For instance, for a floorboard 10 having a predetermined vertical thickness 20 of 1", the horizontal dimension 26 should be about ½", the vertical dimension 28 should be about a ¼", and the wear surface 34 should be 3/16" at minimum, but preferably between ¼" and ½".

Figure 2A:
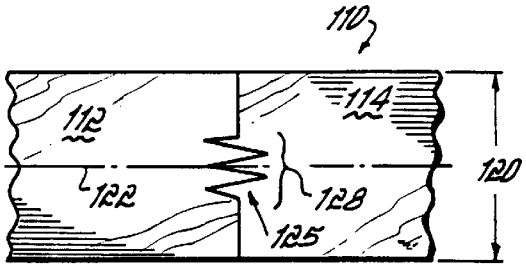
FIGS. 2A and 2B are cross sectional schematics which illustrate the method steps of forming two floorboard sections which may then be laminated onto another material to form two composite floorboards, in accordance with one manner of practicing the invention.
Figure 2B:
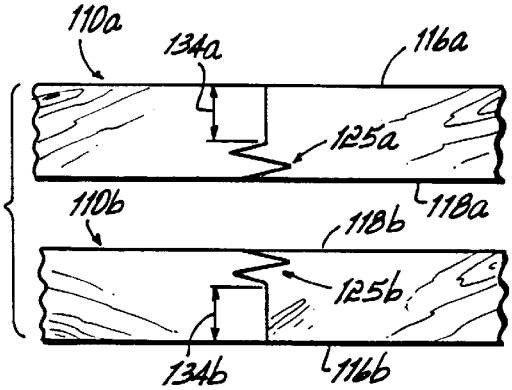
Figure 2C:
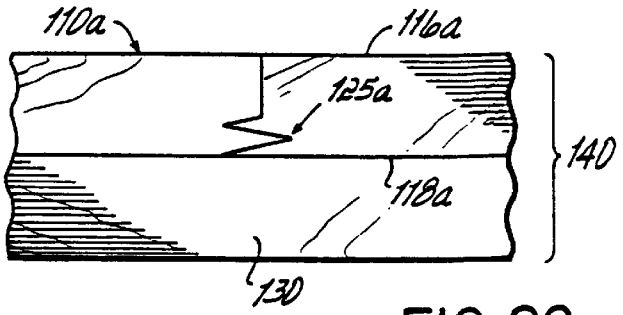
FIG. 2C is a cross sectional schematic of a composite floorboard made in accordance with the method depicted in FIGS. 2A and 2B.

Another embodiment of the invention contemplates providing this wear layer 34 adjacent the top surface 16 of a finger jointed floorboard section which may then be laminated onto another layer of material 130, preferably of lower cost, to produce a composite floorboard 140. FIGS. 2A and 2B show the steps involved in practicing this embodiment of the invention and FIG. 2C shows a composite floorboard 140 resulting from these steps.

More particularly, reference numeral 110 represents an elongated board, formed as an intermediate step by the finger joint connecting of at least two shorter pieces 112 and 114. Reference numeral 125 represents the finger joint connection. Preferably, the vertical dimension 128 of the finger joint connection 125 is in the range of about one-fourth to one-third the vertical dimension 120 of the board 110, and the finger joint connection 125 is centered on a horizontal midplane 122 through the board 110.

The board 110 is sawed or filleted along the horizontal plane 122, producing two identical floorboard sections 110*a* and 110*b*, each of which has a finger joint connection residing adjacent one surface thereof which may then be laminated to a separate support member to form a composite floorboard (not shown). Floorboard sections 110*a* and 110*b* include top surfaces 116*a* and 116*b*, bottom surfaces 118*a* and 118*b*, and sandable wear surfaces 134*a* and 134*b*, respectively.

Figure 3A:
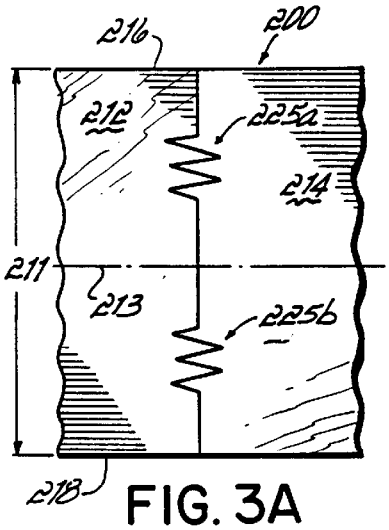
FIGS. 3A, 3B and 3C are cross sectional schematics which illustrate the method steps involved in forming four floorboard sections which may then be laminated onto another material to form four composite floorboards, in accordance with still another manner of practicing the invention.
Figure 3B:
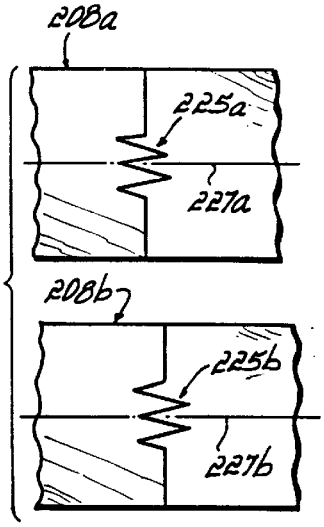
Figure 3C:
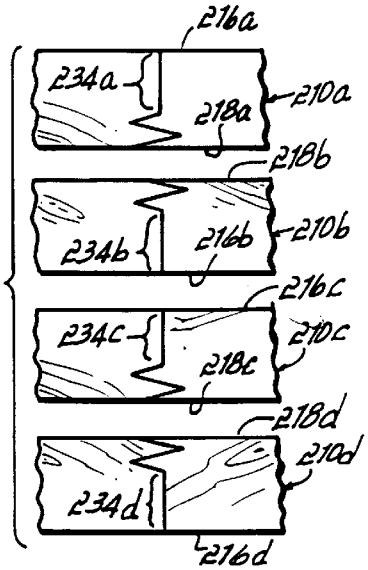

FIGS. 3A, 3B and 3C show another embodiment of the invention which is applicable to initial, finger jointed boards of even greater predetermined thickness. In this embodiment, a finger jointed board 200 is used to ultimately produce four floorboard sections, thereby maximizing the yield of the initial high quality wood which serves as the upper wear surface for a wood floor.

According to this embodiment, the board 200 has two separate, spaced sets of finger joint connections 225*a* and 225*b* which interconnect two shorter pieces 212 and 214. Reference numeral 211 represents the predetermined vertical dimension of board 200, and reference numeral 213 represents the mid point or half way mark of the vertical dimension 211. Preferably, the finger joint connections 225*a* and 225*b* are located and centered half way between the top surface 216 and mid way mark 213 and half way between the bottom surface 218 and midway mark 213, respectively. The overall vertical dimension of each of the finger joint connections 225*a* and 225*b* is preferably one-eighth to one-sixth of the overall vertical dimension 211.

The board 200 is sawed or filleted along a horizontal plane through midpoint 213. This produces two identical, intermediate floorboard pieces 208a and 208*b*, each having a centrally located finger joint connection, 225*a* or 225*b*, respectively. Each of these separate pieces 208*a* and 208*b* is then resawed, or filleted, along a horizontal plane, 227*a* or 227*b*, respectively, which extends through its vertical is midpoint, i.e., through the finger joint connection. As shown in FIG. 3C, this produces four identical floorboard sections 210*a*, 210*b*, 210*c* and 210*d*, each of which has a finger joint connection residing adjacent one surface thereof which may then be laminated onto a separate support member (now shown) to form a composite floorboard.

Each of these floorboard sections 210*a*–210*d* includes a wear surface 234*a*–234*d* which may be sanded without exposing the respective finger joint connection. Except for the initial starting material already having been sawed once, the step from FIGS. 3B to 3C is identical to the step from FIGS. 2A to 2B. Also, with this embodiment, the final step is carried out twice.

Each of the above-described embodiments of the invention provides a relatively thick wear surface for a floorboard or a floorboard section, so that the floorboard or floorboard section may be sanded after installation without exposing any interleaved fingers which form the finger jointed interconnection. Thus, the invention enables a floor manufacturer to reduce the amount of waste that generally results from floorboard production and to simplify installation by producing uniform lengths without sacrificing the aesthetic qualify of an installed floor. Because the invention provides a finger joint connection for shorter pieces which may be sanded without exposing the finger joints, multiple short pieces may be connected to provide uniformity in length for all of the floorboards, preferably a length of 8'. As noted above, this facilitates floorboard installation and further reduces the overall cost of the floor.

Figure 4:
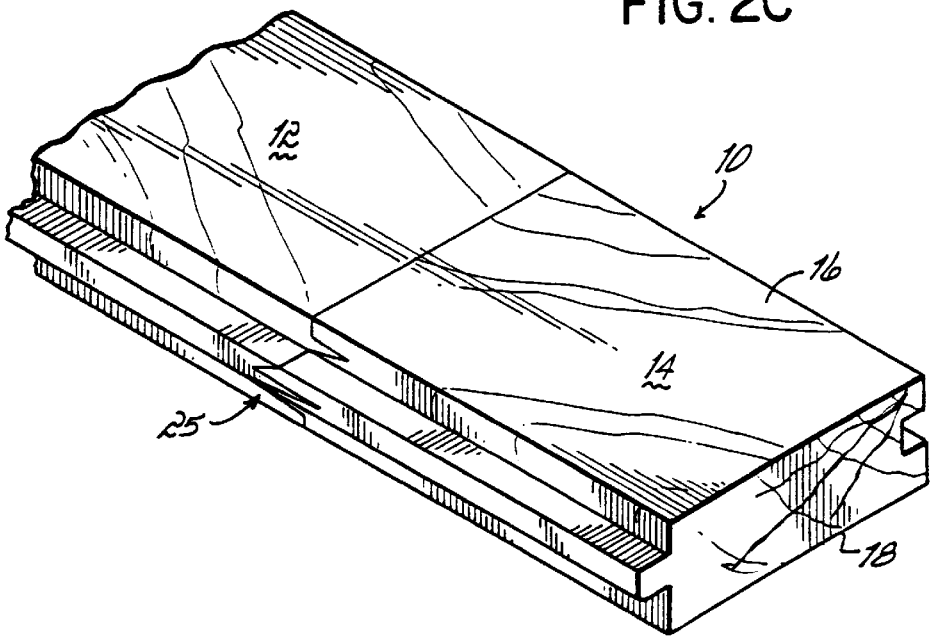
FIGS. 4 and 5 are perspective views showing two different embodiments of the floorboard of the present invention, corresponding to FIGS. 1 and 2C, respectively.
Figure 5:
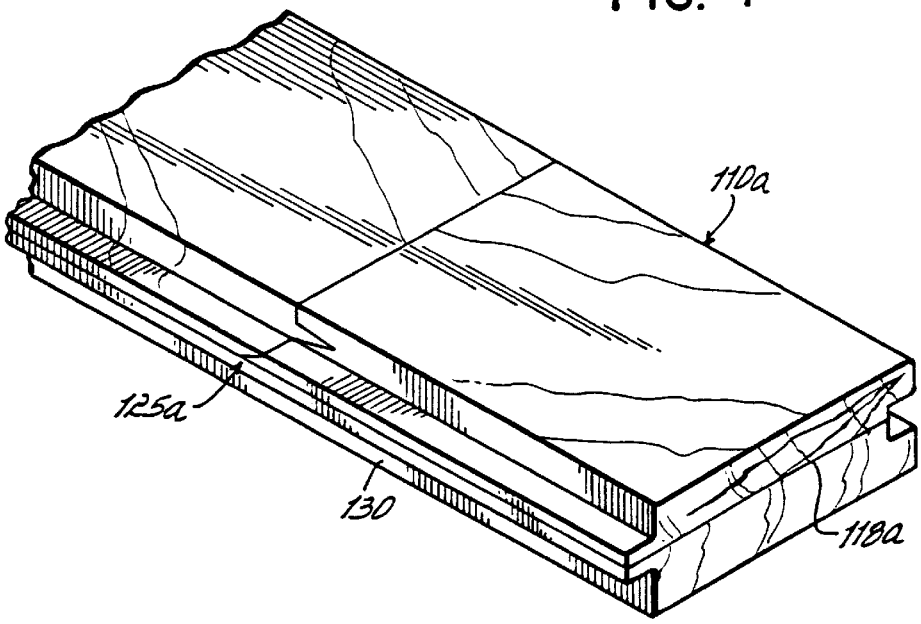

FIG. 4 shows, in greater detail, the floorboard 10 which is depicted in FIG. 1, but after the floorboard 10 has been further subjected to manufacturing steps such that it has a tongue extending along one side thereof and a groove extending along another side thereof, as is well known in the industry. Moreover, FIG. 5 shows similar aspects of the floorboard 140 depicted in FIG. 2C, with the tongue and the groove have been formed along opposite sides thereof.

While a preferred embodiment of the invention has been described, applicant does not wish to be limited thereby, and it is to be understood that various modifications could be made without departing from the spirit of the invention. For instance, while each of the Figures shows one finger joint connection along a single vertical plane, each floorboard or floorboard section may have multiple finger joint connections, due to the interconnection of more than two shorter pieces. Accordingly, it is to be understood that changes may be made without departing from the scope of the invention as particularly set out and claimed.

We claim:

1. A floorboard comprising:

two tongue and groove wooden strips, each having top and bottom surfaces defining a predetermined thickness therebetween, the strips arranged end to end and having a joining line defined by the connection between the strips, a bottom portion of the joining line adjacent the bottom surfaces of the strips being vertical and in vertical alignment with an upper portion of the joining line adjacent the upper surfaces of the strips, and a fingerjoint connection between the upper and lower portions of the joining line defined by interleaved fingers, thereby providing a sandable work surface between the top surfaces of the joined strips and a top portion of the finger joint connection.

2. The floorboard of claim 1 wherein the wear surface is at least 3/16".

3. A composite floorboard comprising:

two wooden strips, each having top and bottom surfaces defining a predetermined thickness therebetween, the strips arranged end to end and having a joining line defined by the connection between the strips, a bottom portion of the joining line adjacent the bottom surfaces of the strips being vertical and in vertical alignment with an upper portion of the joining line adjacent the upper surfaces of the strips, and a finger joint connection between the upper and lower portions of the joining line defined by interleaved fingers, thereby providing a sandable wear surface between the top surfaces of the joined strips and a top portion of the finger joint connection; and a layer of material laminated to the bottom surfaces of the wooden strips thereby to define a composite floorboard of uniform width, the floorboard having one side surface with a horizontal tongue therealong and another side surface with a horizontal groove therealong.

4. A method of manufacturing a floorboard comprising the steps of:

forming horizontally extending fingers in the opposing ends of two pieces of wood, the pieces each having first and second surfaces defining a uniform predetermined thickness therebetween; and interleaving the fingers to joint and secure the two pieces of wood into a composite piece having a joining line defined by the connection between the two pieces of wood, a first portion of the joining line adjacent one of the first and second surfaces being vertical and in vertical alignment with a second portion of the joining line adjacent the other of the first and second surfaces, and a finger joint connection between the first and second portions of the joining line defined by the interleaved fingers, thereby to define a sandable region between the first and second surfaces of the two pieces of wood and the finger joint connection.

5. The method of claim 4 further comprising the steps of:

filleting the composite piece longitudinally along a plane mid-way between the top and bottom surfaces thereof and through the finger joint connection, thereby to form two composite sections each of a thickness which is about half the thickness of the composite piece, each composite section having a portion of the finger joint connection residing adjacent a filleted surface thereof; and adhering the filleted surface of at least one of the composite sections to a support member, thereby to produce a laminated floorboard.

6. A method of manufacturing a floorboard comprising the steps of:

(a) forming horizontally extending fingers in the opposing ends of two pieces of wood, the pieces each having first and second parallel surfaces defining a uniform predetermined thickness therebetween;

(b) interleaving the fingers to joint and secure the two pieces of wood into a composite piece having a joining line defined by the connection between the two pieces of wood, a first portion of the joining line adjacent one of the first and second surfaces being vertical and in vertical alignment with a second portion of the joining line adjacent the other of the first and second surfaces, a finger joint connection between the first and second portions of the joining line defined by the interleaved fingers, and a parallel mid-plane through the composite piece, thereby to define, for each of the first and second surfaces, a sandable region located adjacent thereto;

(c) filleting the composite piece along the parallel mid-plane between the finger joint connection to form two intermediate composite pieces, each intermediate composite piece having a pair of spaced parallel external surfaces with a portion of the finger joint connection residing therebetween;

(d) filleting at least one of the intermediate composite pieces midway between the two external surfaces and through the portion of the finger joint connection residing therebetween, thereby to form a pair of composite sections; and (e) adhering at least one of the composite sections to a support member to produce a laminated floorboard, the laminated floorboard having an upper unadhered wear surface corresponding to one of the external surfaces formed during step (c), and a respective portion of the finger joint connection spaced therefrom to define a sandable wear layer adjacent the upper wear surface.

* * * * *